US009028095B2

(12) United States Patent
Hu

(10) Patent No.: US 9,028,095 B2
(45) Date of Patent: May 12, 2015

(54) LED BULB WITH AMPLIFYING EDGE-EMITTING LIGHT STRUCTURE

(71) Applicant: Wen-Sung Hu, Tainan (TW)

(72) Inventor: Wen-Sung Hu, Tainan (TW)

( * ) Notice: Subject to any disclaimer, the term of this patent is extended or adjusted under 35 U.S.C. 154(b) by 119 days.

(21) Appl. No.: 14/038,845

(22) Filed: Sep. 27, 2013

(65) Prior Publication Data

US 2015/0092409 A1 Apr. 2, 2015

(51) Int. Cl.
*F21K 99/00* (2010.01)

(52) U.S. Cl.
CPC .. *F21K 9/50* (2013.01); *F21K 9/135* (2013.01)

(58) Field of Classification Search
CPC ..... F21K 9/00; F21K 9/13; F21K 9/135
USPC ..... 362/249.02, 235, 294, 311.02, 311.05, 362/311.12
See application file for complete search history.

(56) References Cited

U.S. PATENT DOCUMENTS 5,929,788 A * 7/1999 Vukosic ..... 340/908.1
7,150,553 B2 * 12/2006 English et al. ..... 362/545
8,267,552 B2 * 9/2012 Hu ..... 362/311.02
8,545,052 B2 * 10/2013 Hu ..... 362/249.02
8,926,139 B2 * 1/2015 Reed et al. ..... 362/294
2005/0243552 A1 * 11/2005 Maxik ..... 362/249
2007/0047251 A1 * 3/2007 Sanroma et al. ..... 362/545
2007/0103901 A1 * 5/2007 Reid ..... 362/234
2012/0243235 A1 * 9/2012 Gao ..... 362/294
2014/0254154 A1 * 9/2014 Catalano ..... 362/243
2014/0328066 A1 * 11/2014 Barnetson et al. ..... 362/294
2015/0055338 A1 * 2/2015 Rosenauer et al. ..... 362/231

* cited by examiner

*Primary Examiner* — Ali Alavi
(74) *Attorney, Agent, or Firm* — Alan D. Kamrath; Kamrath IP Lawfirm, P.A.

(57) ABSTRACT

A LED bulb includes a transparent bulb base, a transparent bulb shell, a luminosity module, and a reflector. A bulb adapter is mounted on a lower end of the bulb base. A chamber is defined by the bulb base and the bulb shell, and a driver is mounted in the chamber. The luminosity module mounted in the chamber includes several LEDs and is electrically connected with the driver to allow the LEDs to be driven to project light towards the lower end of the bulb base. The reflector mounted in the chamber and located between the luminosity module and the bulb adapter can reflect light projected toward the lower end of the bulb base by the LEDs for generation of projected sidelight. The LED bulb can promote edge-emitting light which is amplified by downward projected light from the LEDs and rays reflected by the reflector.

8 Claims, 19 Drawing Sheets

LED BULB WITH AMPLIFYING EDGE-EMITTING LIGHT STRUCTURE

BACKGROUND OF THE INVENTION

1. Field of the Invention

The present invention relates to a LED bulb and, more particularly, to a LED bulb with an upward bulb adapter, a projecting light reversely and downward, and an amplifying edge-emitting light.

2. Description of the Related Art

As the green energy policy is highly promoted in international society, many advanced countries have thus set up the utilization deadline for tungsten bulbs. Light-emitting diode (LED) bulbs thus gradually enter the replacement market of tungsten bulbs.

The optical source of traditional tungsten bulbs projects a 360-degree light, but the bulbs currently based on LED (Surface-Mount Device LED or chip) as optical source can only make projection light in single direction. The LED bulbs of single direction projection light can be only utilized in a type of lamp with illumination from the ceiling to the floor. If the LED bulbs are to be used in a standing lamp, a desk lamp, a wall lamp or a bed lamp, the projection direction can be only toward the ceiling. The projection light toward the floor can only rely on the reflected light shined on the slope of the bulb shell of the standing lamp, desk lamp, wall lamp or bed lamp. The illumination is obviously insufficient. Thus, after tungsten bulbs disappear in the market, such types of lamps will all be replaced by energy saving bulbs such as hot cathode fluorescent lamps (HCFL) or cold cathode fluorescent lamps (CCFL).

However, HCFL and CCFL type energy saving bulbs have ultraviolet light, electromagnetic wave and radiation, which are harmful to human body. Hence, if they are used close to human body, the injury will be larger. Furthermore, they contain composition such as Hg, Ar and Ne, wherein Hg is harmful to human's brain, kidney and skin and is a contaminating material to the land too. Further, since the lamp bodies of HCFL, CCFL are usually of glass material, which are very fragile, when they are broken, Hg metal might get released, and once it is contacted by human bodies or is inhaled by human, it will cause brain and kidney disease. Moreover, it takes great cost to decompose the toxicity of the rejected product of HCFL, CCFL, and it does not meet the environmental requirement too. In addition, similar to fluorescent lamps, discharge of HCFL and CCFL type bulbs is a result of the impact of electrode with Hg gas. The generated light beam is of discontinuous light, which will cause vision fatigue of the eye and does not facilitate the reading.

Thus, how to design LED bulbs to match the utilization of lamps such as standing lamps, desk lamps, wall lamps or bed lamps and to increase the illumination scope of the projection light is really the top urgent matter of the LED industries; and it is an important way to promote the concept of environmental protection and energy saving.

BRIEF SUMMARY OF THE INVENTION

Therefore, it is an objective of the present invention to overcome the aforementioned shortcoming and deficiency of the prior art by providing a LED bulb with an amplifying edge-emitting light structure. The LED bulb includes a transparent bulb base, a transparent bulb shell, a support board, a first luminosity module, and a first reflector. The bulb base includes lower and upper ends spaced from each other in a longitudinal direction of the bulb base. A bulb adapter is mounted to the lower end of the bulb base, an opening is formed in the upper end of the bulb base, and a driver is mounted in the bulb base. The bulb shell is engaged with the upper end of the bulb base and seals the opening of the bulb base. The bulb shell and the bulb base together define a chamber. The support board is supported in the chamber and includes an upper end face facing the bulb shell and a lower end face facing the bulb adapter. The first luminosity module is disposed on the lower end face of the support board and includes at least one first LED. The first luminosity module is electrically connected to the driver, allowing the first LED to be driven to project light beams towards the lower end of the bulb base. The first reflector is held in the chamber and between the first luminosity module and the bulb adapter. The first reflector is spaced from the first LED of the first luminosity module in the longitudinal direction, such that the first reflector can reflect rays projected toward the lower end of the bulb base by the first LED for generation of projected sidelight. The LED bulb can promote edge-emitting light which is amplified by downward projected light from the first LED and rays reflected by the first reflector.

In a preferred form, the first reflector includes an annular peripheral portion engaged on an inner wall of the bulb base and a central portion protruding upwardly from an inner circumference of the peripheral portion. The peripheral portion is planar, and the central portion is tapered relative to the peripheral portion.

In examples, the first luminosity module further includes a first substrate mounted on the lower end face of the support board. The first LED is disposed on the first substrate. The LED bulb further includes a second reflector mounted on a lower end face of the first substrate and having at least one through-hole, and the first LED extends through the through-hole. The second reflector is spaced from and opposite to the first reflector in the longitudinal direction, so that an intensified halo effect is attributed to rays reflected by both the first and second reflectors.

In a preferred form, the LED bulb further includes a second luminosity module including a second substrate and at least one second LED mounted on the second substrate. The second substrate is mounted on the upper end face of the support member. The second luminosity module is electrically connected to the driver to allow the second LED to be driven to project light beams toward the bulb shell.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
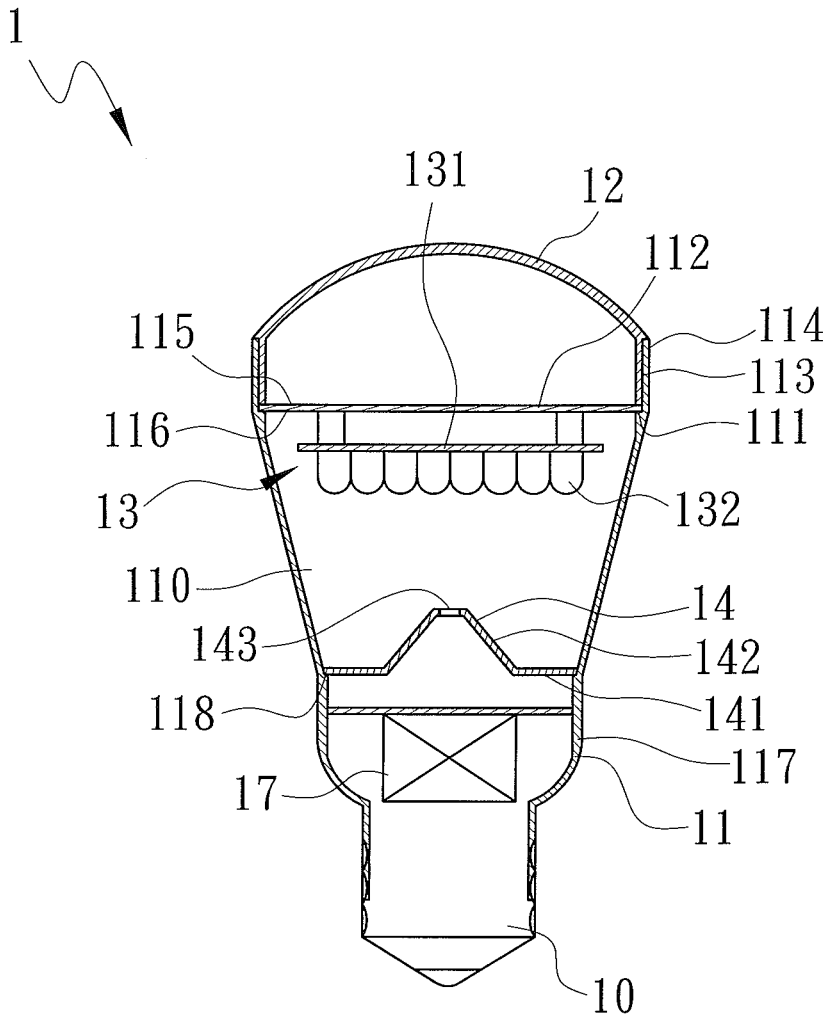
FIG. 1 is a schematic view of a LED bulb of a first embodiment according to the present invention.
Figure 2:
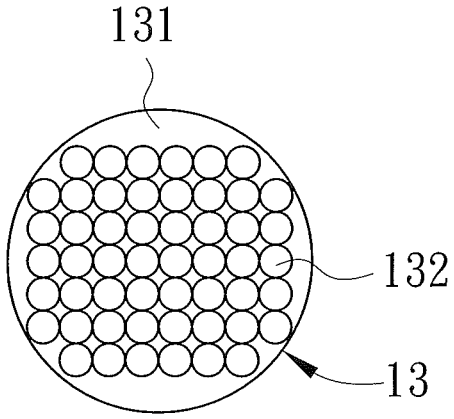
FIG. 2 is a bottom plan view illustrating a luminosity module of the LED bulb of FIG. 1.
Figure 3:
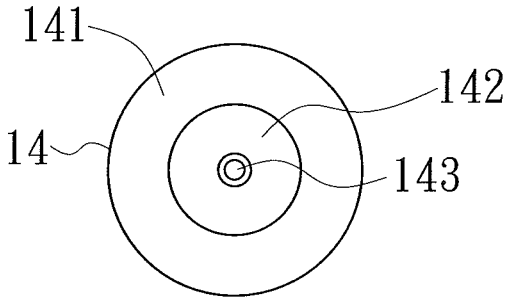
FIG. 3 is a top plan view of a reflector of the LED bulb of FIG. 1.

A LED bulb of a first embodiment of the present invention is shown in FIG. 1 through FIG. 4 of the drawings and generally designated 1. The LED bulb 1 includes a transparent bulb base 11, a transparent bulb shell 12, a luminosity module 13, and a reflector 14. The bulb base 11 includes lower and upper ends 117 and 114 spaced from each other in a longitudinal direction of the bulb base 11. A bulb adapter 10 is mounted to the lower end 117 of the transparent bulb base 11, and an opening 113 is formed in the upper end 114 of the transparent bulb base 11. The bulb shell 12 is engaged with the upper end 114 of the transparent bulb base 11 and seals the opening 113 so that the transparent bulb base 11 and the transparent bulb shell 12 together define a chamber 110 therein. A driver 17 is mounted in the chamber 110. An annular ledge 111 is formed on an inner wall of the upper end 114 of the transparent bulb base 11. A support board 112 is mounted on the ledge 111 so as to be supported within the chamber 110. The support board 112 includes an upper end face 115 facing the transparent bulb shell 12 and a lower end face 116 facing the bulb adapter 10. Furthermore, the driver 17 may be provided with a dimming circuit for a compatible tungsten bulb.

The luminosity module 13 includes a substrate 131 and a plurality of LEDs 132 (Surface-Mount Device LED or chip) on the substrate 131. The substrate 131 is engaged to the lower end face 116 of the support member 112. The luminosity module 13 is electrically connected to the driver 17, so that the LEDs 132 can be driven to project rays toward the lower end 117 of the bulb base 11.

The reflector 14 is held in the chamber 110 and between the luminosity module 13 and the bulb adapter 10 in the longitudinal direction. Furthermore, the reflector 14 is spaced from the LEDs 132 of the luminosity module 13 in the longitudinal direction. The reflector 14 includes an annular peripheral portion 141 engaged on an inner wall of the bulb base 11 and a central portion 142 protruding upwardly from an inner circumference of the peripheral portion 141. In this embodiment, the peripheral portion 141 is planar, and the central portion 142 is tapered relative to the peripheral portion 141. A through-hole 143 is formed in a middle of the central portion 142 of the reflector 14 for penetration of wires. The lower end 117 of the bulb base 11 is provided with an annular ledge 118 on the inner wall thereof to support the reflector 14 which reflects rays projected toward the lower end 117 of the bulb base 11 by the LEDs 132.

Figure 4:
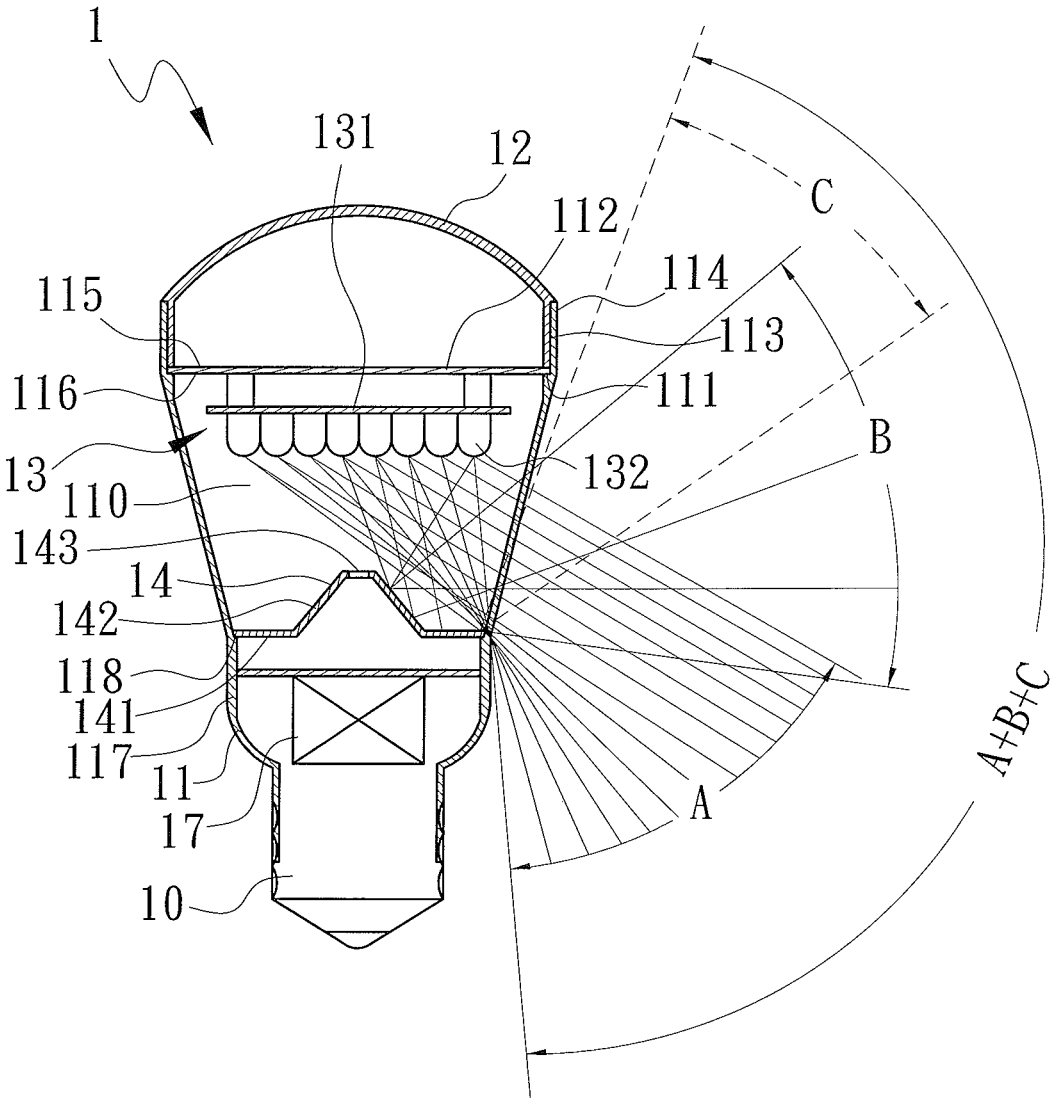
FIG. 4 is a view illustrating rays projected by LEDs of the LED bulb of FIG. 1.

Referring to FIG. 4, the LEDs 132 of the luminosity module 13 of the LED bulb 1 of the present invention generate projected light (A) downward and edge-emitting lights (B) and (C) reflected by the reflector 14, wherein rays of the LEDs 132 are respectively reflected by the bevel central portion 142 and the planar peripheral portion 141 of the reflector 14 to form the edge-emitting light (B) and the edge-emitting light (C), so that edge-emitting light based on the LED bulb 1 is amplified.

Figure 5:
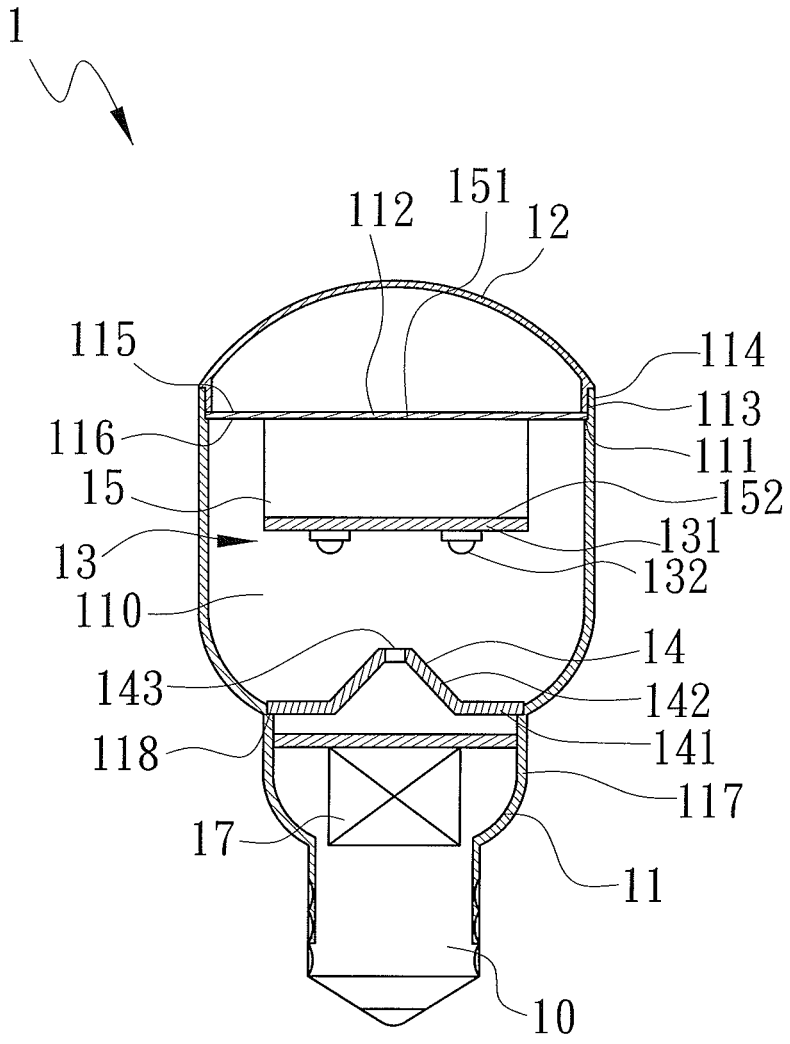
FIG. 5 is a schematic view of a LED bulb of a second embodiment according to the present invention.

FIG. 5 illustrates a LED bulb 1 of a second embodiment of the present invention modified from the first embodiment. In the embodiment, the LED bulb 1 further includes a heat dissipating body 15 disposed in the chamber 110 and engaged to the lower end face 116 of the support board 112. The heat dissipating body 15 includes an upper surface 151 facing transparent bulb shell 12 and a lower surface 152 facing the bulb adapter 10. The upper surface 151 of the heat dissipating bodies 15 can be fixed to support board 112 by fasteners such as screws (not shown). The substrate 131 is mounted on the lower surface 152 of the heat dissipating body 15. The provision of heat dissipating body 15 is determined according to a heat degree out of the LEDs 132.

Figure 6:
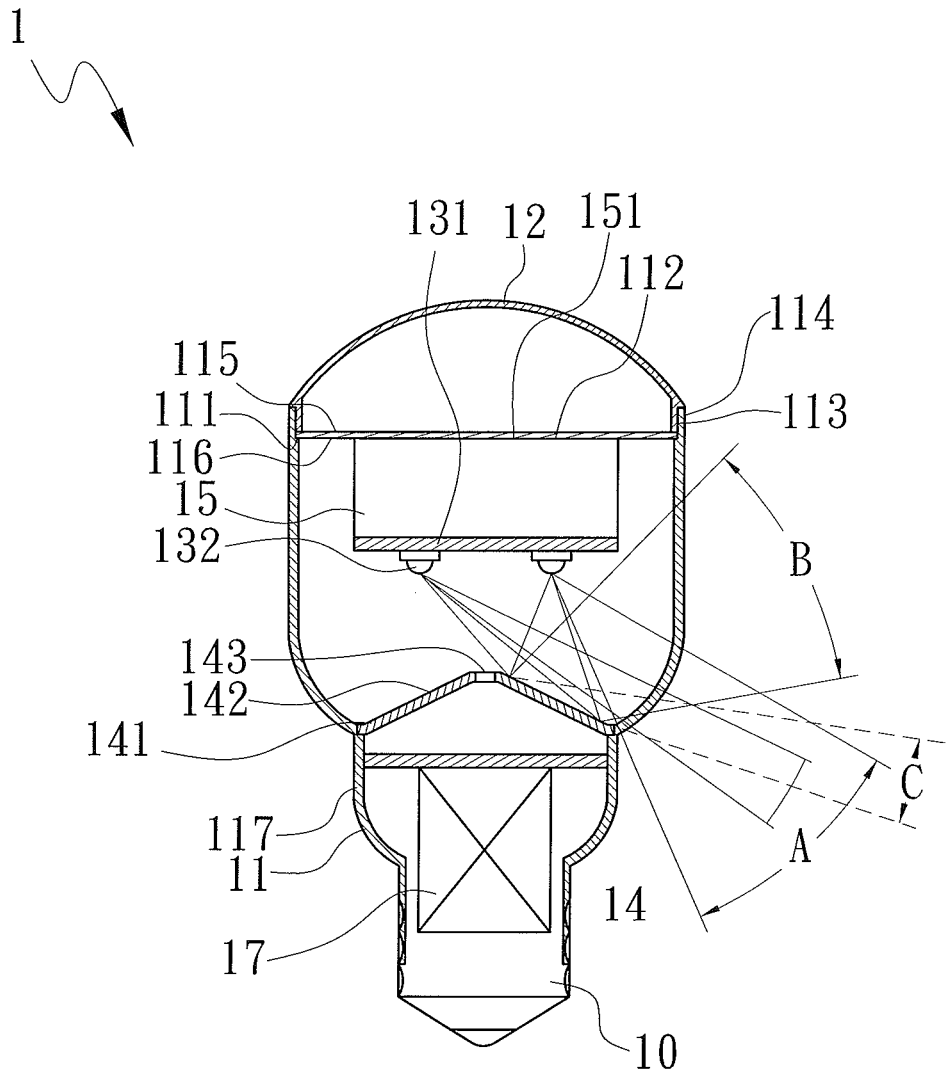
FIG. 6 is a schematic view of a LED bulb of a third embodiment according to the present invention.

The peripheral portion 141 and the central portion 142 of the reflector 14 have sizes changeable according to rays to be projected by the LEDs 132. FIG. 6 illustrates a LED bulb 1 of a third embodiment of the present invention modified from the second embodiment. In the embodiment, the peripheral portion 141 and the central portion 142 of the reflector 14 are tapered or conical in cross section overall. FIG. 6 illustrates the edge-emitting lights (B) and (C) out of the reflector 14 which reflects rays from the LEDs 132 for amplified edge-emitting light of the LED bulb 1.

Figure 7:
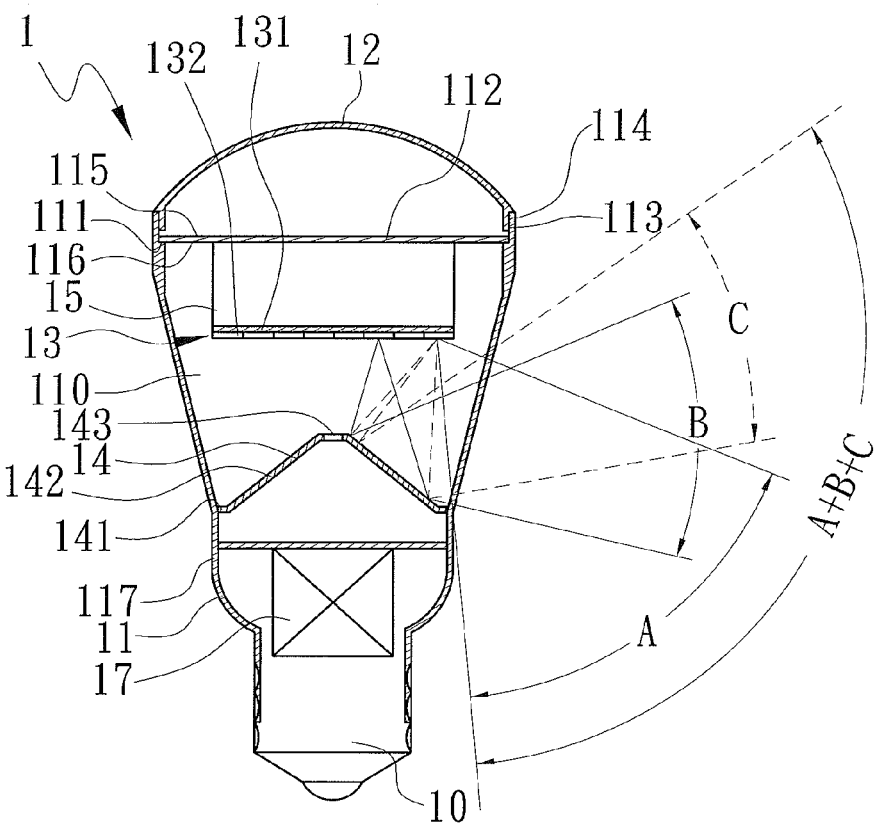
FIG. 7 is a schematic view of a LED bulb of a fourth embodiment according to the present invention.
Figure 8:
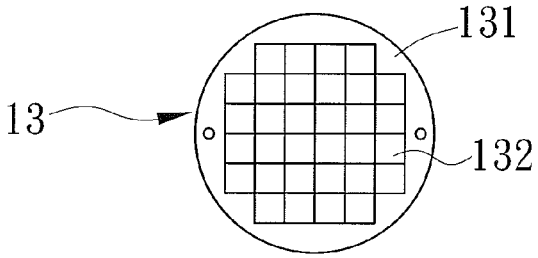
FIG. 8 is plan view illustrating a luminosity module of the LED bulb of FIG. 8.

The central portion 142 of the reflector 14 has a changeable gradient according to rays projected by the LEDs 132, and the count or the disposition of the LEDs 132 is flexible according to an environmental requirement. FIGS. 7 and 8 illustrate a LED bulb 1 of a fourth embodiment of the present invention modified from the third embodiment. In the embodiment, the gradient of the central portion 142 of the reflector 14 and the count of the LEDs 132 are different from that of the LED bulb 1 of the third embodiment.

Figure 9:
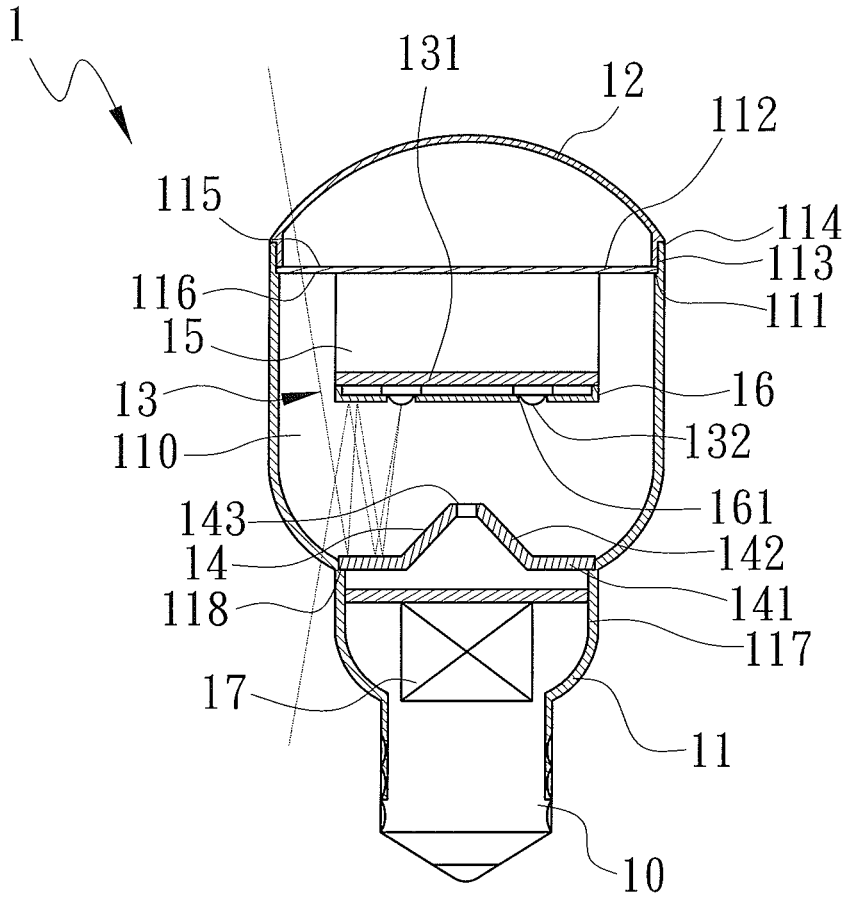
FIG. 9 is a schematic view of a LED bulb of a fifth embodiment according to the present invention.
Figure 10:
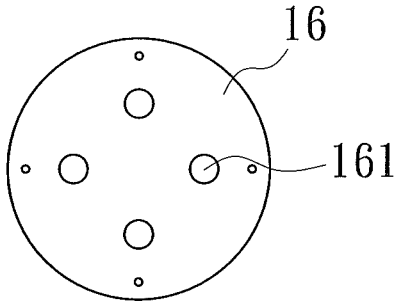
FIG. 10 is a plan view illustrating a second reflector of the LED bulb of FIG. 9.

FIGS. 9 and 10 illustrate a LED bulb 1 of a fifth embodiment of the present invention modified from the second embodiment. In the embodiment, the LED bulb 1 further includes a second reflector 16 mounted on a lower end face of the substrate 131 and having a plurality of through-holes 161 spaced from each other for penetration of the LEDs 132. The second reflector 16 is spaced from and opposite to the reflector 14 in the longitudinal direction. Referring to FIG. 9, an intensified halo effect is attributed to rays reflected by both the reflector 14 and the second reflector 16.

Figure 11:
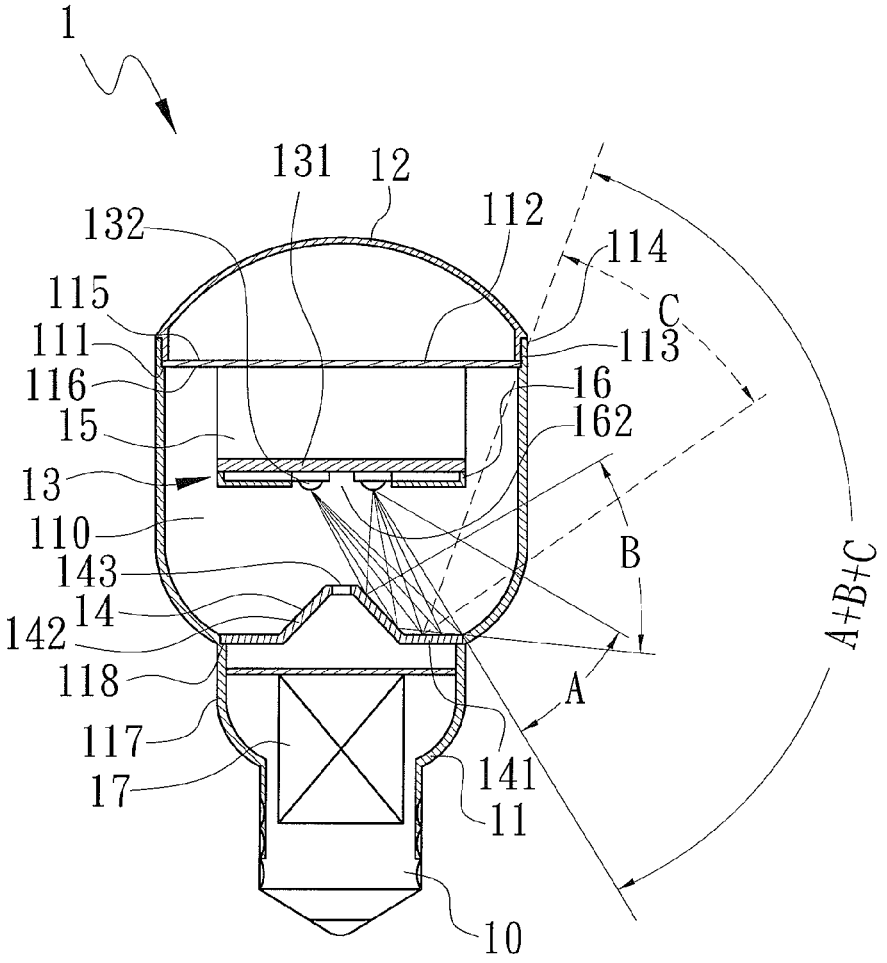
FIG. 11 is a schematic view of a LED bulb of a sixth embodiment according to the present invention.

FIG. 11 illustrates a LED bulb 1 of a sixth embodiment of the present invention modified from the fifth embodiment. In the embodiment, a through-hole 162 is formed in a center of the second reflector 16 for penetration of the LEDs 132. As shown in FIG. 11, edge-emitting light of the LED bulb 1 is amplified by the edge-emitting lights (B) and (C) because rays out of the LEDs 132 are reflected by the reflector 14.

Figure 12:
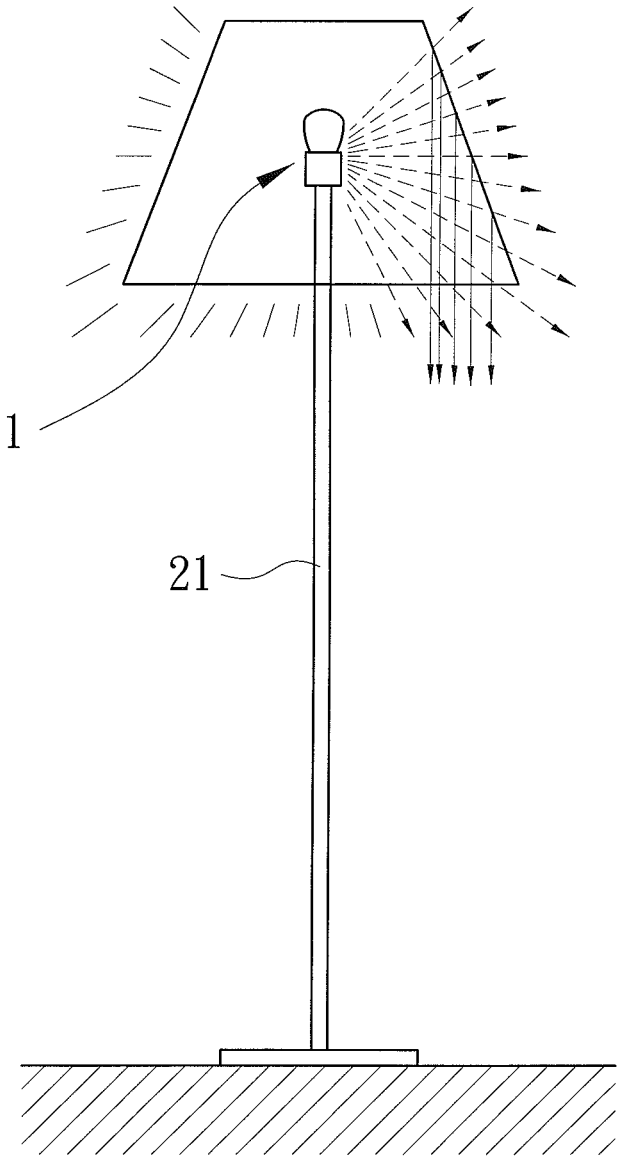
FIG. 12 is an illustration of projection light of the LED bulb of the present invention used in a standing lamp.
Figure 13:
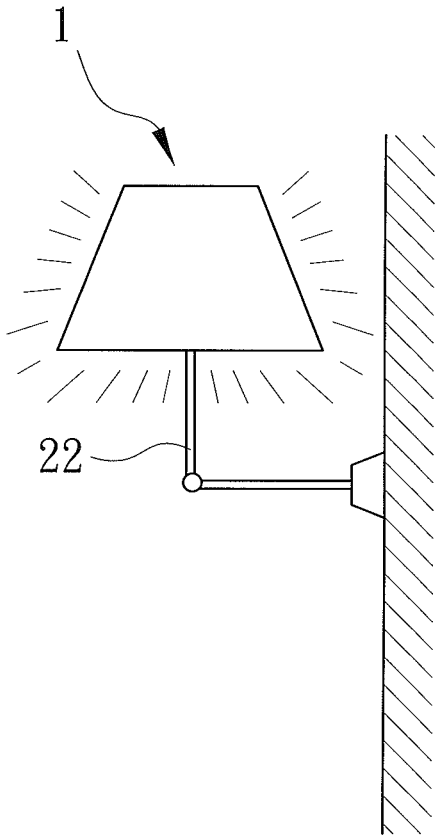
FIG. 13 is an illustration of projection light of the LED bulb of the present invention used in a wall lamp.
Figure 14:
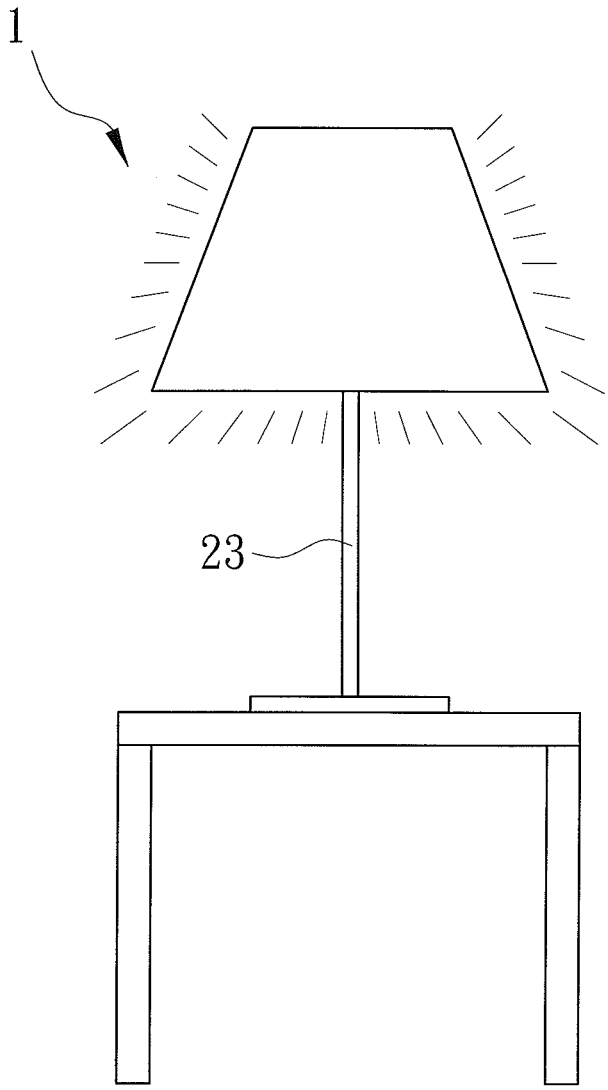
FIG. 14 is an illustration of projection light of the LED bulb of the present invention used in a desk lamp.
Figure 15:
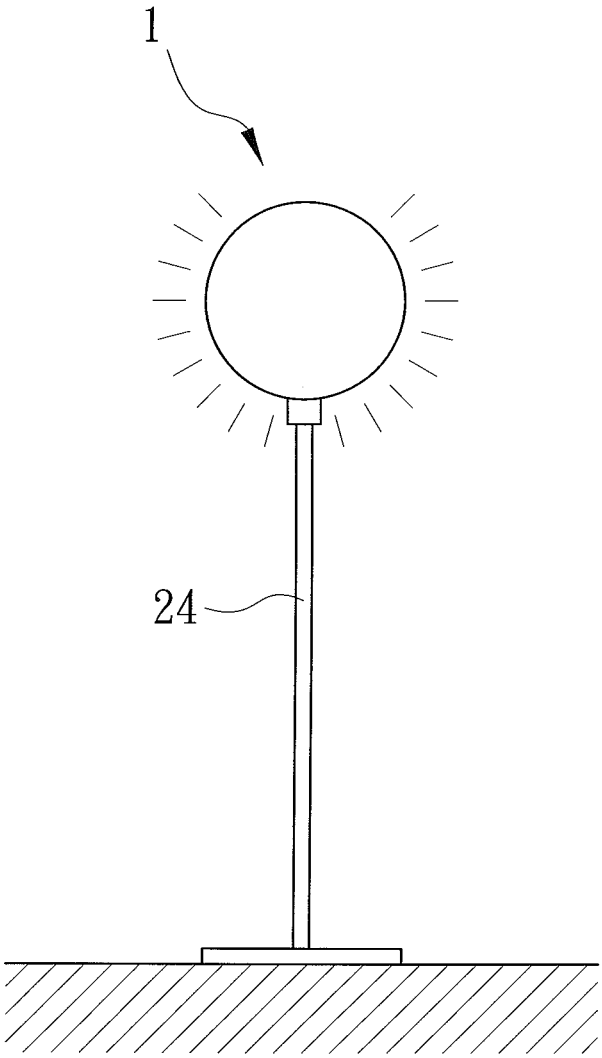
FIG. 15 is an illustration of projection light of the LED bulb of the present invention used in a landscaping light.
Figure 16:
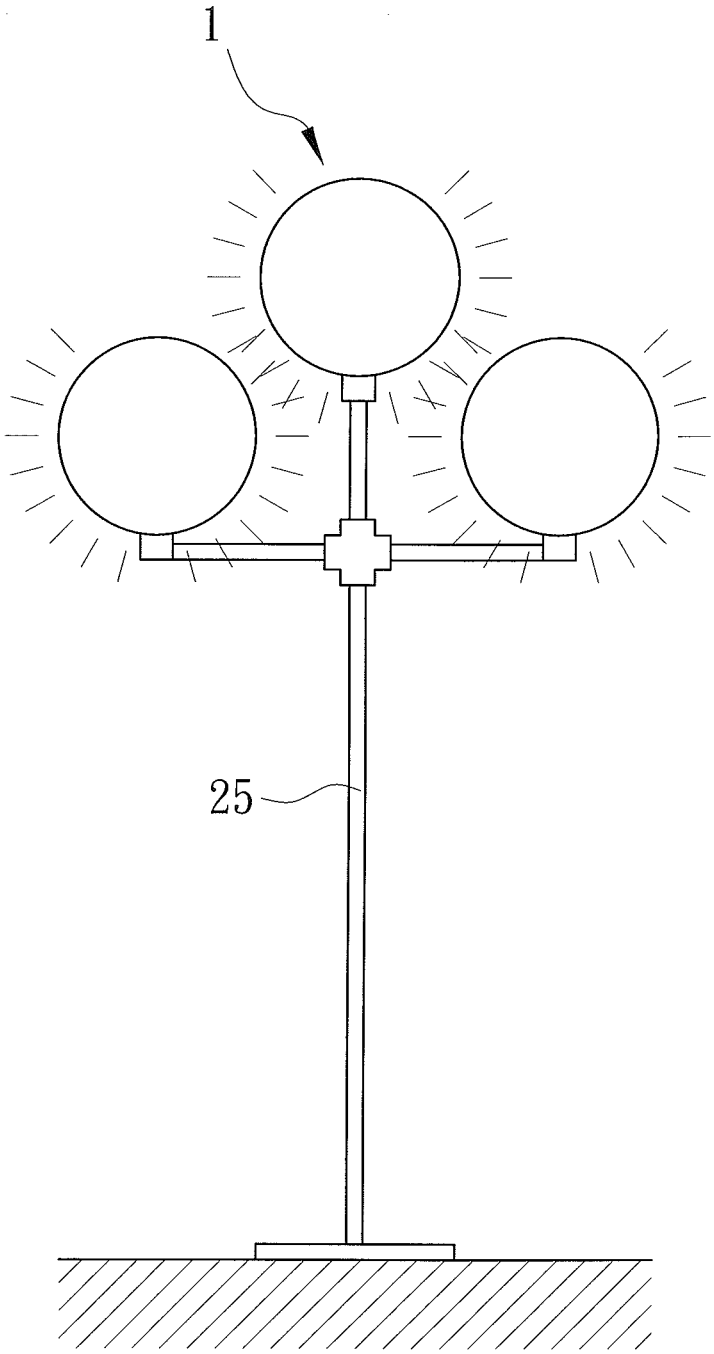
FIG. 16 is an illustration of projection light of the LED bulb of the present invention used in another landscaping light.

In use, the LED bulb 1 of each preferred embodiment of the present invention is adapted to utilize in a standing lamp 21 shown in FIG. 12, a wall lamp 22 shown in FIG. 13, a desk lamp 23 shown in FIG. 14 or landscaping lights 24, 25 shown in FIG. 15 and FIG. 16. In these examples, illumination of a lamp in the downward and lateral directions is sufficient because of amplified edge-emitting light of the LED bulb 1 which coordinates with a lampshade of the standing lamp 21, the wall lamp 22 or the desk lamp 23 or translucent bulb shells of the landscaping lights 24, 25.

Figure 17:
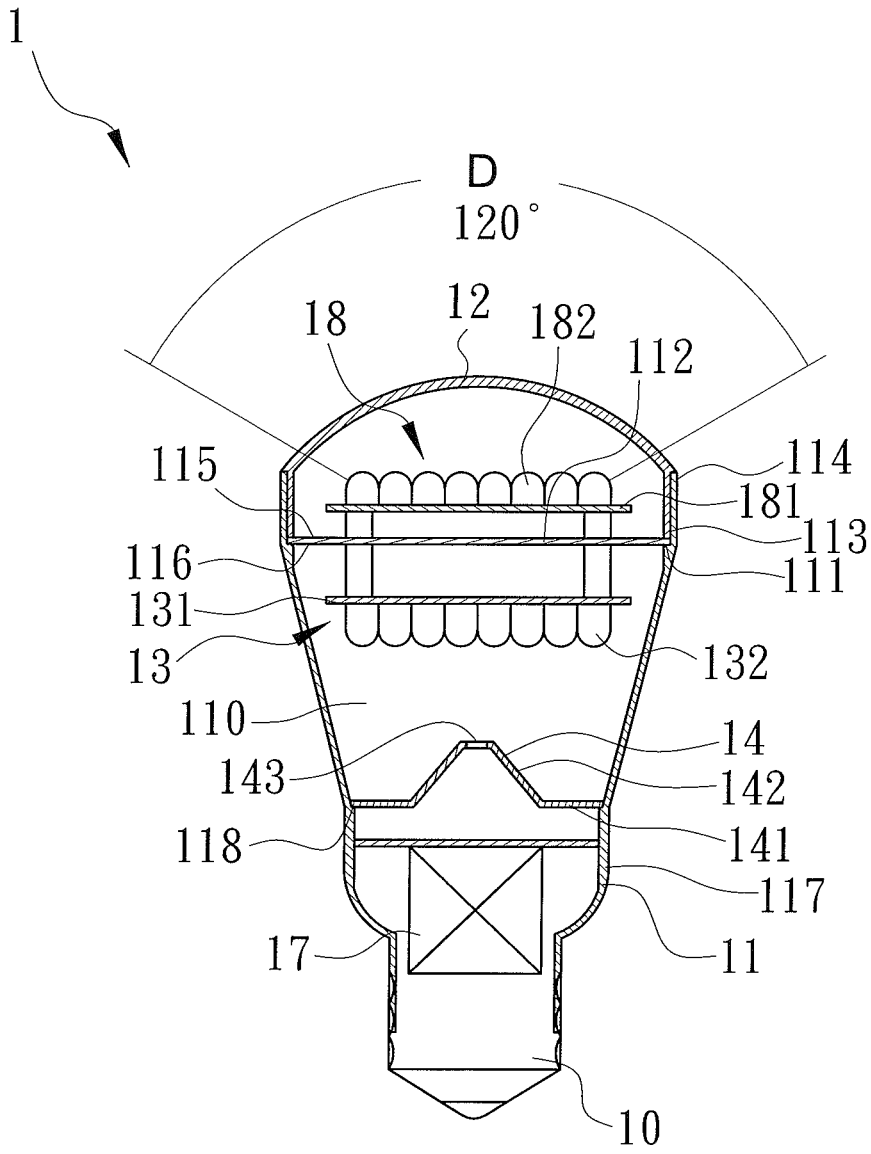
FIG. 17 is a schematic view of a LED bulb of a seventh embodiment according to the present invention.

FIG. 17 illustrates a LED bulb 1 according to a seventh embodiment of the present invention modified from the first embodiment. Description of the parts of the LED bulb 1 shown in FIG. 17 identical to those shown in FIG. 1 is omitted. In particular, the LED bulb 1 further includes a second luminosity module 18 by which the LED bulb 1 generates upward projected light (D), such that the LED bulb 1 projects full-angle light beams. The second luminosity module 18 includes a second substrate 181 and a plurality of LEDs 182 (Surface-Mount Device LED or chip) on the substrate 181. The second substrate 181 is mounted on the upper end face 115 of the support member 112. The second luminosity module 18 is electrically connected to the driver 17, so that the LEDs 182 can be driven to project light toward the bulb shell 12.

Figure 18:
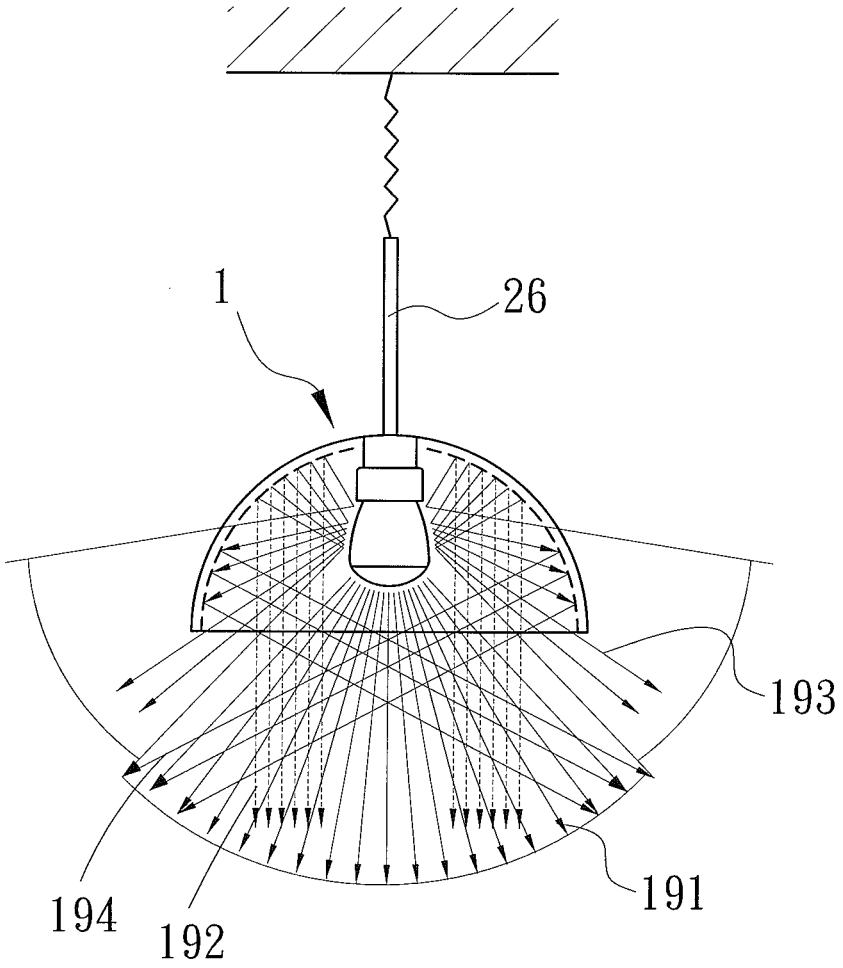
FIG. 18 is an illustration of projection light of the LED bulb of the present invention used in a pendant lamp.
Figure 19:
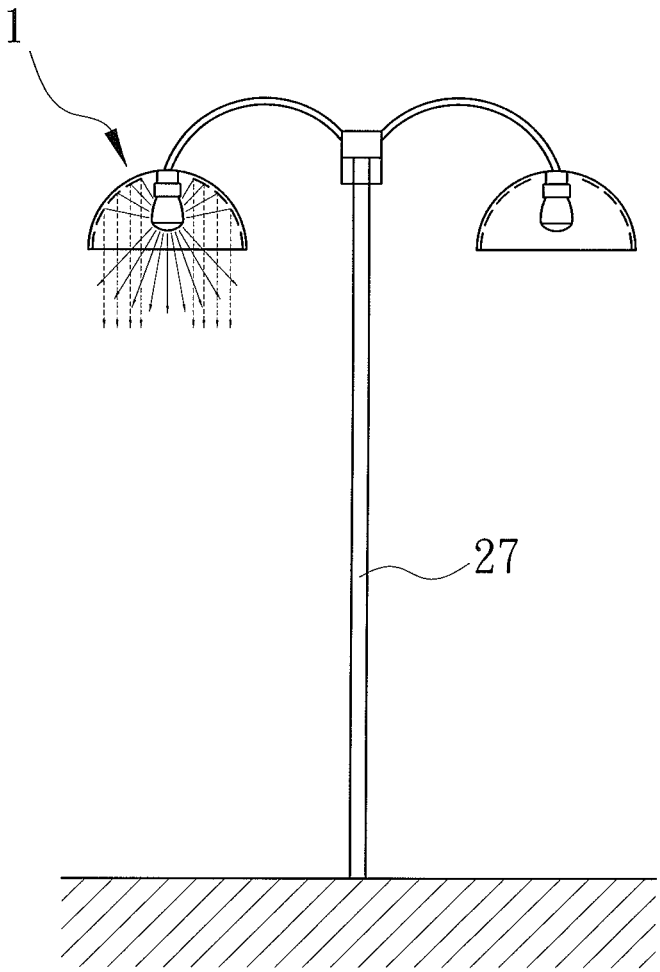
FIG. 19 is an illustration of projection light of the LED bulb of the present invention used in a streetlight.

In virtue of the LEDs 132 and 182 of the luminosity modules 13 and 18 for downward and upward projected lights, the LED bulb 1 in FIG. 17 can be further installed in a lamp which includes a parabolic reflector for projection of light downward, for example, a pendant lamp 26 (FIG. 18) and a streetlight 27 (FIG. 19), in addition to a standing lamp, a wall lamp, a desk lamp and a landscaping light. As shown in FIG. 18, direct light projected by the LEDs 182 in FIG. 17 is indicated by arrows 191. Reflected light toward the ground floor is created by a parabolic reflector which reflects projected light out of the LEDs 132 and is indicated by arrows 192.

Sidelight radiated beyond the parabolic reflector is created by the reflector 14 in FIG. 17 which reflects projected light out of the LEDs 132 and is indicated by arrows 193. Reflected sidelight radiated on the parabolic reflector is created by the reflector 14 in FIG. 17 which reflects projected light out of the LEDs 132 and is indicated by arrows 194. All types of light combined intensify not only original LED-related illumination and beam angles but also ambient illumination.

Figure 20:
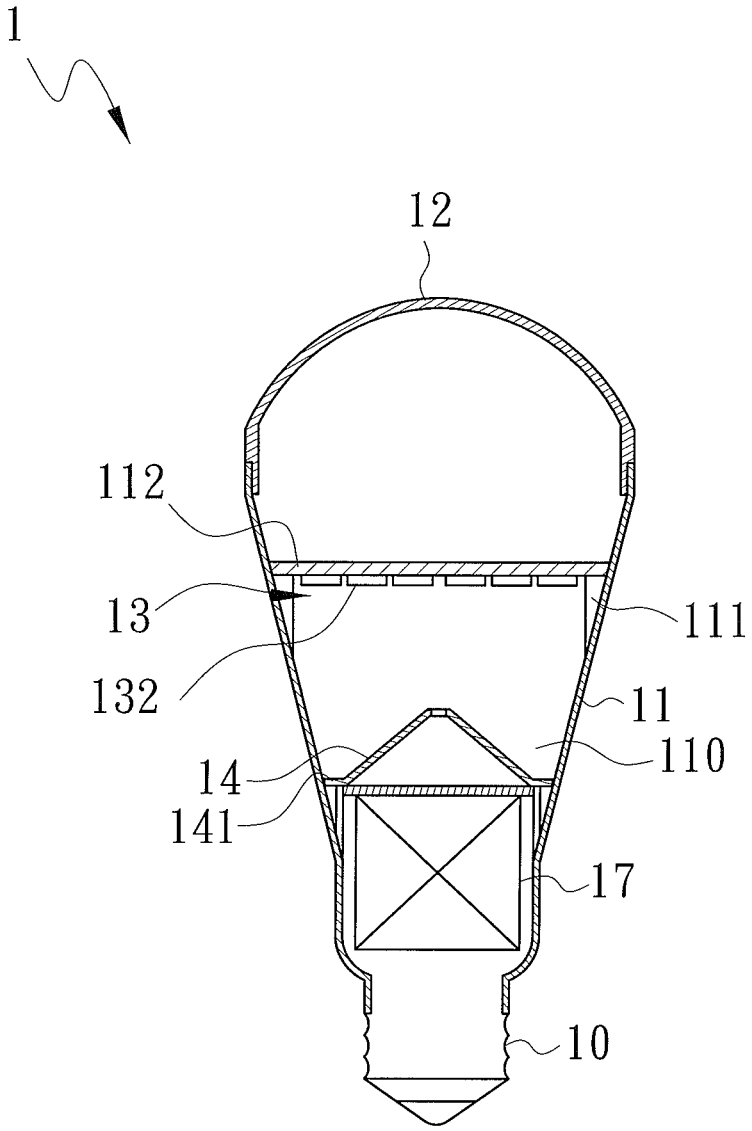
FIG. 20 is a schematic view of a LED bulb of an eighth embodiment according to the present invention.

FIG. 20 illustrates a LED bulb 1 according to an eighth embodiment of the present invention modified from the first embodiment. In this embodiment, the support member 112 carried by the ledge 111 is a single-sided printed circuit board, with the LEDs 132 of the luminosity module 13 mounted on a lower end face of the printed circuit board.

Figure 21:
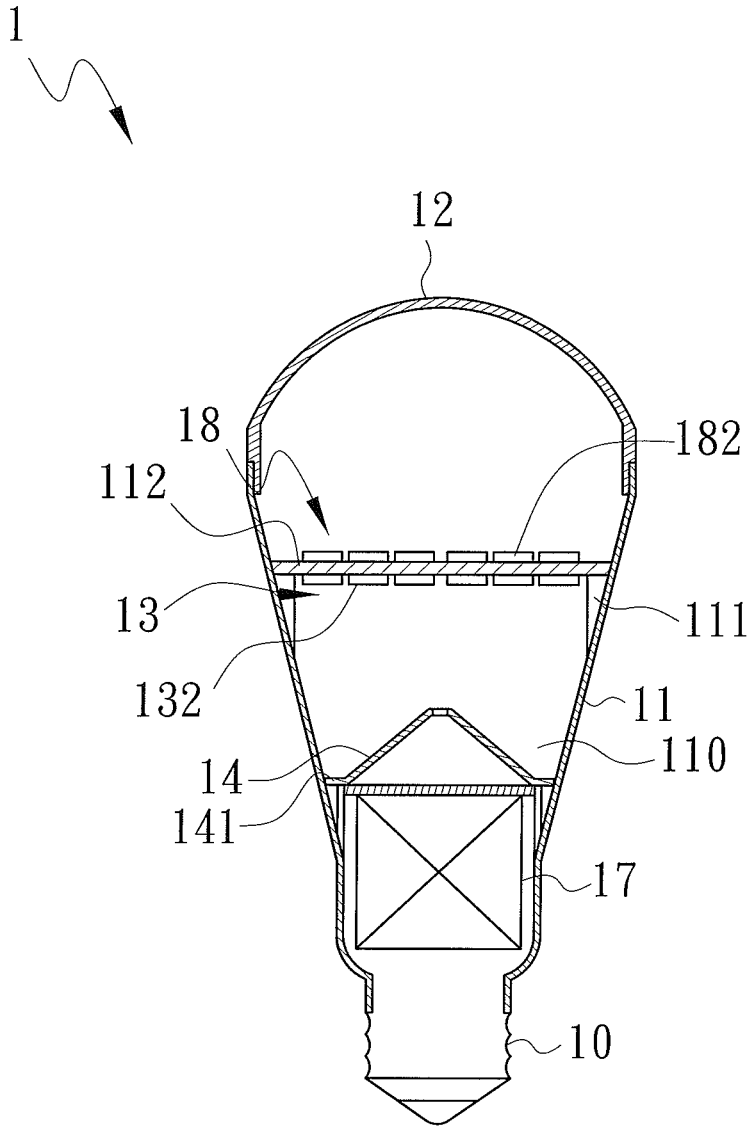
FIG. 21 is a schematic view of a LED bulb of a ninth embodiment according to the present invention.

FIG. 21 illustrates a LED bulb 1 according to a ninth embodiment of the present invention modified from the eighth embodiment. In this embodiment, the support member 112 carried by the ledge 111 is a double-sided printed circuit board, with the LEDs 132 of the luminosity module 13 mounted on a lower end face of the printed circuit board and with the LEDs 182 of the second luminosity module 18 mounted on an upper end face of the printed circuit board.

Figure 22:
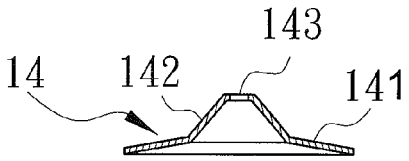
FIGS. 22 through 27 are schematic views illustrating reflectors in other six embodiments of the LED bulb of the present invention.
Figure 25:
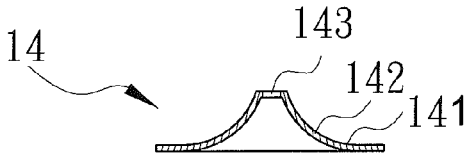
Figure 23:
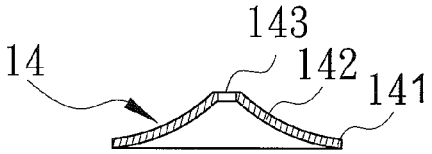
Figure 26:
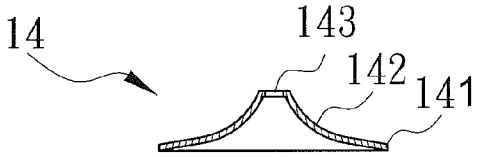
Figure 24:
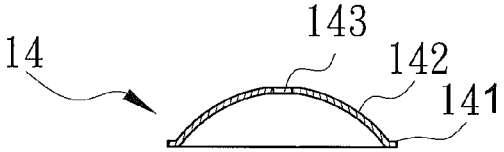
Figure 27:
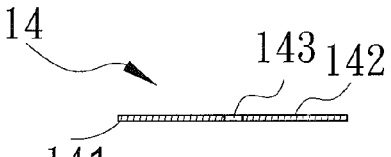

FIGS. 22 through 27 illustrate the reflectors 14 of the LED bulb 1 of the present invention in other six embodiments. The peripheral portion 141 of the reflector 14 in FIG. 22 is a bevel tapered section having a different gradient with the tapered central portion 142, the peripheral and central portions 141 and 142 of the reflector 14 in FIG. 23 are concave arc-shaped in cross section, the central portion 142 of the reflector 14 in FIG. 24 is convex arc-shaped in cross section, the central portion 142 of each of the reflectors 14 in FIGS. 25 and 26 is formed as a concave arc-shaped section with a specific radian, and the reflector 14 in FIG. 27 is in the form of a planar. Although specific embodiments have been illustrated and described, numerous modifications and variations are still possible without departing from the essence of the invention. The scope of the invention is limited by the accompanying claims.

The invention claimed is:

1. A LED bulb comprising:

a transparent bulb base including lower and upper ends spaced from each other in a longitudinal direction of the bulb base, with a bulb adapter mounted to the lower end of the bulb base, with an opening formed in the upper end of the bulb base, with a driver mounted in the bulb base;

a transparent bulb shell engaged with the upper end of the bulb base and sealing the opening of the bulb base, with the bulb shell and the bulb base together defining a chamber;

a support board supported in the chamber and including an upper end face facing the bulb shell and a lower end face facing the bulb adapter;

a first luminosity module disposed on the lower end face of the support board and including at least one first LED, with the first luminosity module electrically connected to the driver, allowing the at least one first LED to be driven to project light beams towards the lower end of the bulb base; and a first reflector held in the chamber and between the first luminosity module and the bulb adapter, with the first reflector spaced from at least one first LED of the first luminosity module in the longitudinal direction, with the first reflector reflecting rays projected toward the lower end of the bulb base by the at least one first LED.

2. The LED bulb according to claim 1, wherein the first luminosity module further includes a first substrate mounted on the lower end face of the support board, with the at least one first LED disposed on the first substrate.

3. The LED bulb according to claim 2 further comprising:

a heat dissipating body received in the chamber and supported by the support board, with the heat dissipating body including an upper surface facing the bulb shell and a lower surface facing the bulb adapter, with the first substrate mounted on the lower surface of the heat dissipating body, with a ledge formed on an inner wall of the upper end of the bulb base, with the support board mounted on the ledge.

4. The LED bulb according to claim 2, wherein the first reflector includes an annular peripheral portion engaged on an inner wall of the bulb base and a central portion protruding upwardly from an inner circumference of the peripheral portion, with the peripheral portion being planar, with the central portion being tapered relative to the peripheral portion, with a through-hole formed in the central portion of the first reflector for penetration of wires, with each of the peripheral portion and the central portion having a size changeable according to rays projected by the at least one first LED.

5. The LED bulb according to claim 2, wherein the first reflector includes an annular peripheral portion engaged on an inner wall of the bulb base and a central portion protruding upwardly from an inner circumference of the peripheral portion, with the central portion of the first reflector being convex arc-shaped or concave arc-shaped in cross section.

6. The LED bulb according to claim 3, wherein an annular ledge is formed on an inner wall of the lower end of the bulb base to support the first reflector.

7. The LED bulb according to claim 3 further comprising:

a second reflector mounted on a lower end face of the first substrate and having at least one through-hole, with the second reflector spaced from the first reflector in the longitudinal direction, with the at least one first LED extending through the least one through-hole of the second reflector.

8. The LED bulb according to claim 4 further comprising:

a second luminosity module including a second substrate and at least one second LED mounted on the second substrate, with the second substrate mounted on the upper end face of the support member, with the second luminosity module electrically connected to the driver, allowing the at least one second LED to be driven to project light beams toward the bulb shell.

* * * * *